United States Patent [19]

Lichau et al.

[11] Patent Number: 4,799,340

[45] Date of Patent: Jan. 24, 1989

[54] BARRIER FOR UTILITY POLE

[75] Inventors: James W. Lichau; Patricia K. Lichau, both of 16426 Old Stage Coach Rd., Walton, Oreg. 97490; Steven D. Hanson, Eugene, Oreg.

[73] Assignees: James W. Lichau; Patricia K. Lichau, both of Walton, Oreg.

[21] Appl. No.: 926,258

[22] Filed: Nov. 3, 1986

[51] Int. Cl.[4] ..... E04B 1/70

[52] U.S. Cl. ..... 52/170; 52/514; 52/728; 405/255

[58] Field of Search ..... 52/170, 727, 728, 514, 52/169.14; 405/255; 383/27, 87, 113, 114

[56] References Cited

U.S. PATENT DOCUMENTS

| | | | |
|---|---|---|---|
| 516,530 | 3/1894 | Harvey | 52/170 |
| 1,329,026 | 1/1920 | Snyder | 52/170 |
| 1,419,108 | 6/1922 | Bitting | 52/170 X |
| 2,316,385 | 4/1943 | Abramson | 383/114 |
| 2,396,565 | 3/1946 | Gardner | 383/114 |
| 2,724,156 | 11/1955 | Shaw | 52/170 |
| 2,842,179 | 7/1958 | Hoeppner | 383/87 |
| 3,015,918 | 1/1962 | Schoen | 383/87 |
| 3,117,712 | 1/1964 | Kugler | 383/87 |
| 3,362,124 | 1/1968 | Du Val Cravens et al. | 52/728 X |
| 4,253,507 | 3/1981 | Williamson | 383/114 |
| 4,521,910 | 6/1985 | Keppel | 383/113 |

FOREIGN PATENT DOCUMENTS

| | | | |
|---|---|---|---|
| 68564 | 2/1914 | Austria | 52/728 |
| 1331643 | 9/1973 | United Kingdom | 383/87 |

*Primary Examiner*—John E. Murtagh

*Attorney, Agent, or Firm*—James D. Givnan, Jr.

[57] ABSTRACT

An enclosure constituting a barrier for a buried segment of a pole to prevent leaching of pole preservatives into the ground. Pliable sheet material is formed into a tubular sheath by means of a lengthwise seam. A closure is formed at the lower end of the sheath by folding and a thermal weld. A band at the barrier upper end may be shrunk to close the barrier snugly about the pole.

1 Claim, 1 Drawing Sheet

BARRIER FOR UTILITY POLE

BACKGROUND OF THE INVENTION

The present invention pertains generally to enclosures appled to the buried end segments of poles installed by various utility companies.

Utility poles are usually treated with various chemical compounds to prolong pole life. Certain of the components used, while enhancing pole life, are toxic and upon leaching from the pole constitute a degree of risk to health and the environment. Existing treatments and devices for application to utility poles are directed toward pole preservation and do not address the problem of the leaching of toxic material from poles. Typical chemical treatments may include chloropicrin and pentachlorophenol which are considered toxic.

Some efforts have been made to wrap mid-pole segments near ground level for pole protection from moisture and infestation.

Shoes or boot structures for poles are disclosed in U.S. Pat. Nos. 12,385; 822,131; 868,953; 2,724,156 and 1,982.569. U.S. Pat. No. 982,380 discloses a pole support with a separate bottom member on which rests the pole end.

SUMMARY OF THE PRESENT INVENTION

The present invention is directed toward the provision of a barrier for isolating the buried end segment of a pole from ambient earthen material and vice versa.

A tube of pliable film material is formed of a cross section approximating that of the pole. An expedient way of such tube formation is the forming of sheet stock into a tube. Lapped margins of the tube material are joined as by thermal welding. The lower extremity of the tube is closed in a manner which avoids risk of damage to the material during pole installation into a ground hole. The tube lower end is preferably folded with the folded portions being secured to one another as by thermal welding. Cinch means may be applied about the barrier upper end prevents the entry of water. The cinch means may utilize material which may be shrunk in place.

Important provisions include the provision of a pole barrier of pliable material which fully isolates the buried end segment of a pole to increase pole life as well as confine pole preservatives to prevent soil contamination; the provision of a barrier which lends itself to low cost manufacture, ease of shipping and storage and installation; the provision of a barrier which isolates the lower end segment of a buried pole for a period of several years, and the provision of a barrier for isolating a pole or piling from ambient material (earthen or liquid) as well as destructive organisms.

DETAILED DESCRIPTION OF THE PREFERRED EMBODIMENTS

Figure 1:
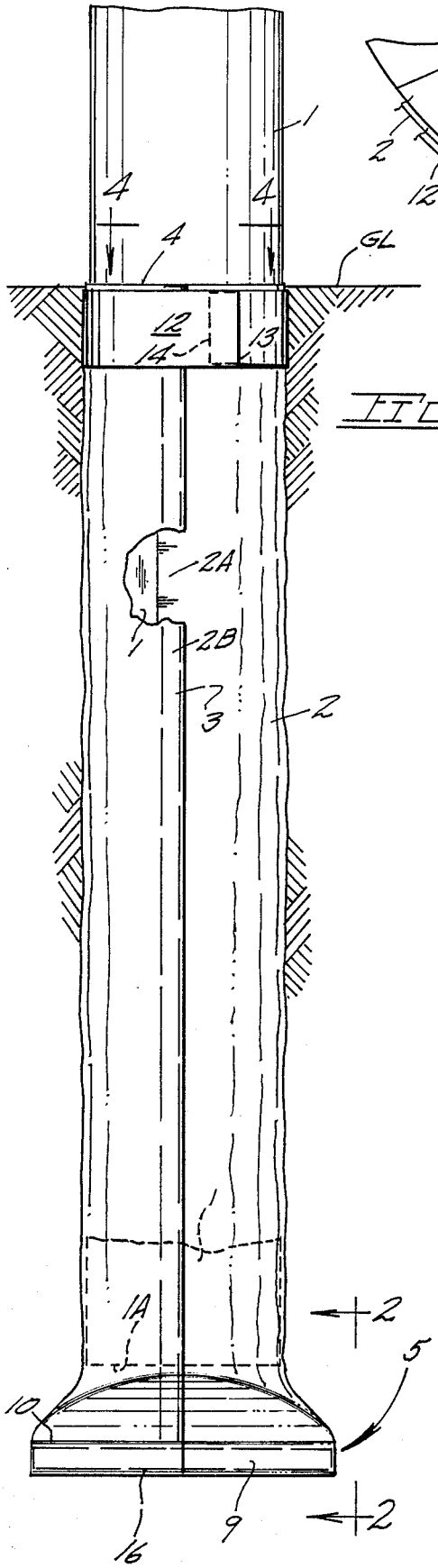
FIG. 1 is an elevational view of the present barrier in place on a buried pole end segment.
Figure 4:
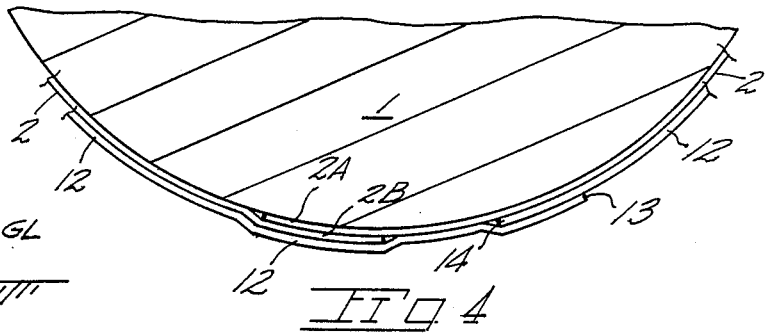
FIG. 4 is a horizontal sectional view taken downward along line 4—4 of FIG. 1.
Figure 2:
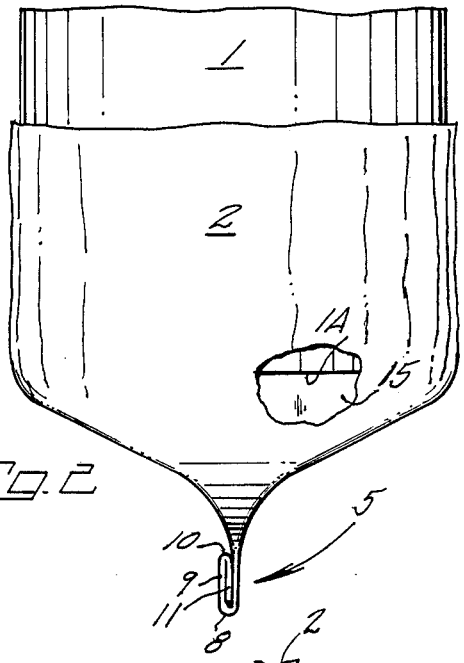
FIG. 2 is an elevational view taken along line 2—2 of FIG. 1.
Figure 3:
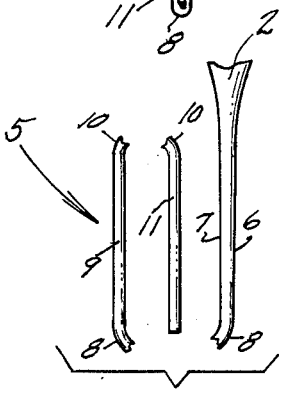
FIG. 3 is an exploded view of the folded portion of the barrier.

With continuing attention to the drawings wherein applied reference numerals indicate parts similarly hereinafter identified, the reference numeral 1 identifies a post of the type used by utility companies and municipalities. Such posts commonly range from a foot or so to approximately a foot and a half in diameter and have an end segment several feet in length for burial in a prepared site. Earthen fill material is deposited about the end segment. Such posts are usually treated with one or more preservatives prior to installation. A ground line is at GL.

The present barrier is indicated at 2 in place about pole 1 and is of tubular shape having its upper end 4 adjacent the ground surface. Lapped vertical margins at 2A–2B of the barrier are joined to form a seam 3. The seam may be a weld or other suitable means such as dielectrically, an adhesive or fusing of the sheet material.

A barrier lower extremity closure is indicated generally at 5 and is located below the pole end at 1A. The closure for the barrier is formed from the tubular material being shaped into flattened overlying or juxtaposed members 6 and 7. The members are reversed upwardly by a bend at 8 into a first fold 9 and preferably reversed again at a bend 10 into a second or internal fold 11. The lower extremity of the barrier is sealed as by thermal welding at 16 or other suitable means as above noted along the transverse length of the transversely disposed parallel folds 9 and 11 to secure same to the initially converged juxtaposed members 6 and 7 of the barrier. A seam of one inch width is adequate.

The upper end of the barrier may be held against the pole surface by a band 12. One such band is a wrapped length of durable synthetic material having overlapped ends 13–14 for securement to one another as by a thermal weld. A chamber at 15 is defined by the barrier and pole end 1A.

One suitable material for the barrier is high-density polyethylene sheet material of a thirty mil rating. The thickness of the material used may vary somewhat to best serve the conditions under which the barrier is utilized e.g., pole diameter and weight, ground material, etc.,. Further, such material when used for the barrier and for band 12 may be shrunk in the field by the application of heat such as by use of heated air from a portable blower or other heat source.

While the foregoing description has been in conjunction with utility poles, it is to be understood that pilings may similarly be barrier equipped to isolate same from both earthen material and water as well as confining pole preservatives from escape into such ambient bodies.

As wooden pole diameters are not held to close tolerances and may vary substantially, the present barrier is highly practical in that one size barrier may accommodate a wide range of pole diameter variances in distinction to a molded or fabricated pole barrier constructed from rigid or semi-rigid material. The earthen fill material placed about the barrier equipped pole will urge the barrier into pole contact. Further the high density material has a low surface coefficient of friction to avoid pole displacement upon heaving of the ground about the pole. The high density material noted is particularly suited to resisting penetration by insects and other forms of animal life.

While we have shown but one embodiment of the invention, it will be apparent to those skilled in the art that the invention may be embodied still otherwise without departing from the spirit and scope of the invention.

Having thus described the invention, what is desired to be secured in a Letters Patent is:

1. A barrier for application to an end segment of a pole or piling, said barrier comprising, synthetic sheet material of a pliable nature having joined lapped vertical margins providing a seam to form the material into an elongate tubular sheath of circular section corresponding generally to the pole diameter, said seam joined by a thermal weld, an upper extremity of the sheet material defining an open area for pole reception, said sheet material terminating downwardly and thereat forming closure means including multiple folds to prevent the passage of material into or out of said barrier, said sheet material defining a chamber subjacent the end of a pole or piling therein and, cinch means of synthetic material extending about the upper extremity of the sheet material to urge same into engagement with the pole or piling surface, said cinch means being thermally responsive to shrink in the presence of heat.

* * * * *